US005425646A

United States Patent [19]

Green

[11] Patent Number: 5,425,646

[45] Date of Patent: Jun. 20, 1995

[54] PRINTED CIRCUIT CONNECTOR ASSEMBLY

[75] Inventor: Anthony J. Green, Oxenhope, England

[73] Assignee: Methode Electronics, Inc., Chicago, Ill.

[21] Appl. No.: 100,490

[22] Filed: Jul. 30, 1993

[30] Foreign Application Priority Data

Jul. 31, 1992 [GB] United Kingdom ..... 9216301

[51] Int. Cl.[6] ..... H01R 23/68

[52] U.S. Cl. ..... 439/79; 439/357

[58] Field of Search ..... 439/79, 80, 59, 676, 439/350, 357, 76, 329, 629, 630

[56] References Cited

U.S. PATENT DOCUMENTS

| | | | |
|---|---|---|---|
| 2,891,103 | 6/1959 | Swengel | 439/350 |
| 4,629,266 | 12/1986 | Viselli | 439/344 |
| 4,679,879 | 7/1987 | Triner | 439/676 |
| 4,708,415 | 11/1987 | White | 439/59 |
| 4,717,218 | 1/1988 | Ratcliff | 439/79 |
| 4,767,338 | 8/1988 | Dennis et al. | 439/55 |
| 4,778,410 | 10/1988 | Tanaka | 439/676 |
| 4,878,848 | 11/1989 | Ingalsbe | 439/76 |
| 4,924,076 | 5/1990 | Kitamura | 235/492 |
| 4,980,856 | 12/1990 | Ueno | 364/900 |
| 5,004,430 | 4/1991 | DelGuidice et al. | 439/350 |
| 5,035,641 | 7/1991 | Van-Santbrink | 439/329 |
| 5,035,649 | 7/1991 | Collier et al. | 439/329 |
| 5,118,312 | 6/1992 | Lu | 439/676 |
| 5,132,877 | 7/1992 | Branan et al. | 439/329 |
| 5,176,528 | 1/1993 | Fry et al. | 439/181 |
| 5,207,586 | 5/1993 | MacGregor et al. | 439/76 |
| 5,336,099 | 8/1994 | Aldous et al. | 439/329 |

FOREIGN PATENT DOCUMENTS

| | | |
|---|---|---|
| 0233742A2 | 8/1987 | European Pat. Off. . |
| 0337632A1 | 10/1989 | European Pat. Off. . |
| 2169156 | 7/1986 | United Kingdom . |
| WO86/00474 | 1/1986 | WIPO . |
| WO89/02166 | 3/1989 | WIPO . |

*Primary Examiner*—Neil Abrams
*Attorney, Agent, or Firm*—David L. Newman

[57] ABSTRACT

A printed circuit connector assembly comprising a printed circuit card, a connector element mounted on the card for providing electrical connection with the circuitry thereon, a housing for the card formed with an opening within the connector element being exposed, and a plug element insertable within the opening into engagement with the connector element for providing external electrical connection, the connector element and the plug element respectively having metal contacts arranged to make resiliently yieldable wiping contact with one another when the plug element is inserted within the opening, and the housing and the plug element having at least one inter-engageable projection and recess for releasably locking the plug element in engagement with the connector element.

10 Claims, 2 Drawing Sheets

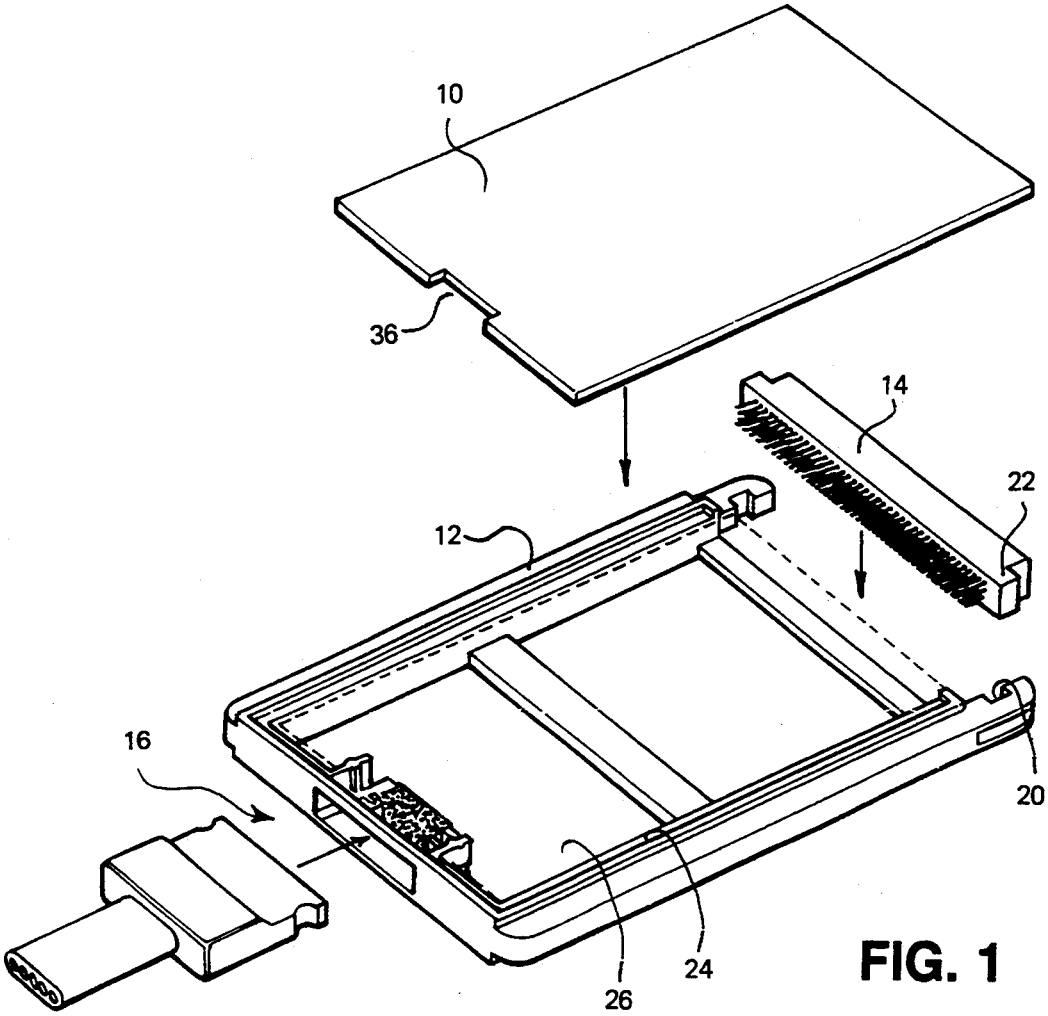
FIG. 1
FIG. 3
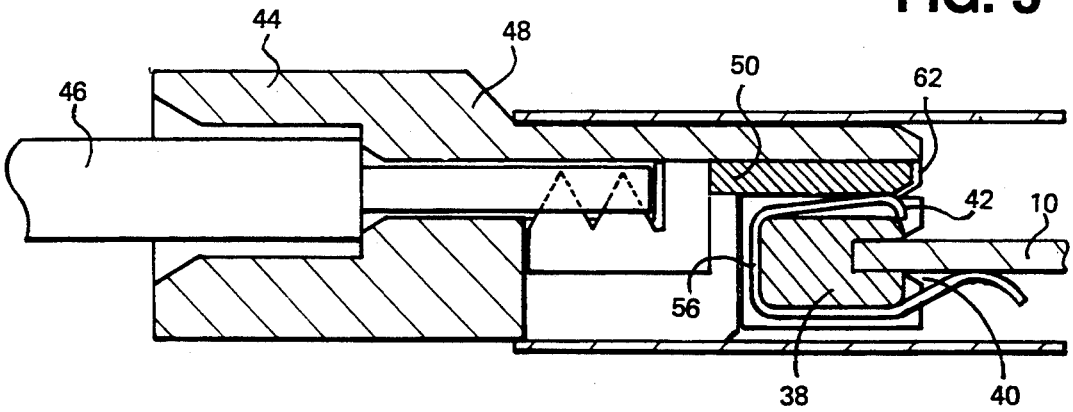

PRINTED CIRCUIT CONNECTOR ASSEMBLY

BACKGROUND OF THE INVENTION

This invention concerns a printed circuit connector assembly.

A conventional interconnection for a printed circuit card comprises male and female parts, one of which is provided with a multiple array of contacts and the other of which is provided with a corresponding array of mating contacts. The leads of one part are soldered to input/output terminals on the printed circuit card while the leads of the other part are joined to the wires of a cable.

A significant problem with this kind of connector is the space with it requires if it is to be made sufficiently robust to withstand repeated connection and disconnection.

It is an aim of the present invention to overcome this problem by providing an arrangement permitting a compact and repeatedly usable construction for a printed circuit interconnection.

SUMMARY OF THE INVENTION

According to the invention, a printed circuit connector assembly comprises a printed circuit card, a connector element mounted on the card for providing electrical connection with the circuitry thereon, a housing for the card formed with an opening within which the connector element is exposed, and a plug element insertable within the opening into engagement with the connector element for providing external electrical connection, the connector element and the plug element respectively having metal contacts arranged to make resiliently yieldable wiping contact with one another when the plug element is inserted within the opening, and the housing and the plug element having at least one inter-engageable projection and recess for releasably locking the plug element in engagement with the connector element.

The projection and recess may be respectively a rib and a channel, or a rounded bump and a dimple, for example. In one embodiment respective side walls of the opening and the plug element are formed with the projection and recess. In another embodiment, an upper wall of the opening and a top surface of the plug element are formed with the projection and recess. An advantage of this embodiment is that it creates a vertical pressure on the plug element, which may be used to ensure a positive contact between the metal contacts of the connector element and the plug element as described below.

Preferably, the metal contacts of a least one of the plug and connector elements comprise metal contacts spaced from one another by insulating ribs.

Advantageously, there is a rigid connection between the card and the housing adjacent the opening in order to minimize flexing stress on the printed circuit card during repeated reconnection of the connector assembly. For example, the card may be supported in a slot within the housing.

Similarly, there is preferably a rigid connection between the connector element and the printed circuit card. For example, the card may be produced with a recess or cut-out for receiving the connector element, and the connector element may have edge slots for receiving the recessed edges of the printed circuit card.

DESCRIPTION OF THE DRAWINGS

The invention is described further, by way of example, with reference to the accompanying drawings, in which:

FIG. 1 is an exploded perspective view of a first embodiment of a connector assembly for a printed circuit card according to the present invention;

FIG. 3 is a section through the connector assembly in the assembled condition, and;

DESCRIPTION OF THE CURRENT EMBODIMENTS

Figure 2:
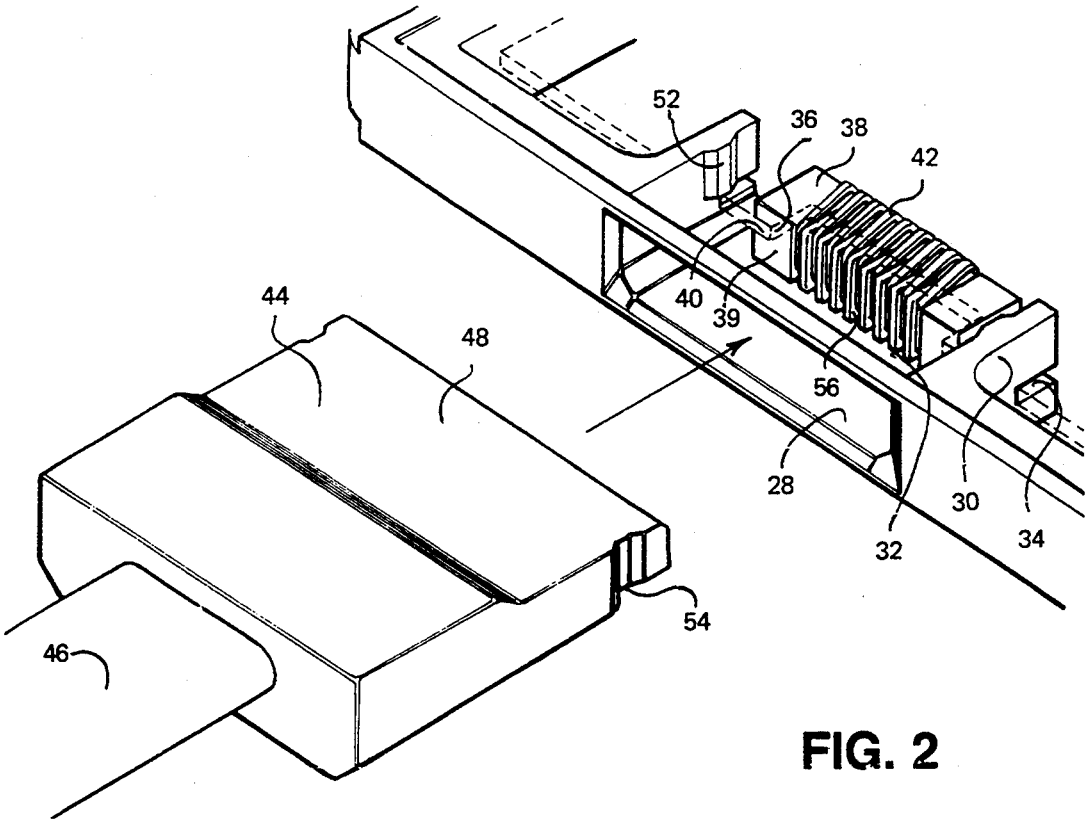
FIG. 2 is an enlarged perspective view of the connector assembly.

Referring initially to FIGS. 1 to 3, a connector assembly or interconnection according to the present invention comprises a printed circuit card 10, which is mounted in a housing 12 and which has a conventional female connector 14 at one end and a connector assembly 16 according to the invention at an opposite end.

The housing 12 surrounds the printed circuit card 10 on three sides and is formed with recesses 20 for receiving ears 22 of the connector 14 to locate the connector 14 on the fourth side of the printed circuit card. The connector 14, being conventional will not be described further. A shallow indentation 24 in each of the upper and lower surfaces of the housing 12 serves for receiving a respective cover plate 26 for closing the housing with the printed circuit card 10 inside for protection against damage, wear and the effects of the atmosphere.

The connector assembly according to the invention is illustrated in greater detail in FIGS. 2 and 3. As shown, the housing 12 is formed with an opening 28 defined by rearwardly extending side walls 30 and upper and lower walls 32 (only the lower wall being illustrated). Each of the side walls 30 is formed with a slot 34 within which the printed circuit card 10 is received to hold rigidly a region of the printed circuit card 10, which is exposed within the opening 28.

This region of the printed circuit card 10 is formed with a recess or cut-out 36 which receives a connector element 38. The connector element 38 has generally rectangular plastics body 39 formed with slots 40 around its periphery for engaging the recessed edges of the printed circuit card 10 with a firm friction fit, again to provide a rigid connection. The connector element 38 includes metal contacts 42 (described in greater detail below), which are soldered to input/output terminals of the circuitry on the printed circuit card 10.

A plug element 44 mounted on a cable 46 is insertable within the opening 28 to engage the connector element 38 and thereby provide a connection between external apparatus and the circuitry of the printed circuit card 10. The plug element 44 includes a plastics body 48 and metal contacts 50 (described in greater detail below), and is releasably locked within the opening 28 by way of inter-engageable projections 52 and recesses 54. More especially, the side walls 30 of the opening 28 of the housing 12 have internal ribs providing the projections 52, and side walls of the plug element body 48 have corresponding channels providing the recesses 54.

The connector element 38 is formed with a series of ribs 56, which serve to space the metal contacts 42 both from one another and, in addition, from the lower cover plate 26 of the housing 12. Each of the metal contacts 42 comprises a spring metal strip wrapped around the connector element 38, with one end soldered to a respective input/output terminal of the printed circuit card 10 and with the other end spaced a little above the body 39 of the connector element 38 to allow this other end to be resiliently depressed in the vertical direction. Likewise, the plug element 44 is formed with a series of fibs 62 (shown in FIG. 3), which serve to space the metal contacts 50 of the plug element 44 from one another. In the plug element 44, the metal contacts are simple metal strips embedded in the plastics material of the body 48.

As the plug element 44 is inserted into the opening 28, the metal contacts 50 are brought into wiping contact with the metal contacts 42 of the connector element 38, pressing them down to form a firm electrical connection. The ribs 52 engage the channels 54 to lock the plug element 44 in position and ensure that the electrical connection is maintained. Further, the rigid connection between the printed circuit card 10 and the housing 12, by virtue of the slots 34, and the rigid connection of the connector element 38 with the printed circuit card 10, by virtue of the slots 40 in the connector element 38, ensure that repeated reconnection does not exert undue flexing stress on the printed circuit card 10.

Figure 4:
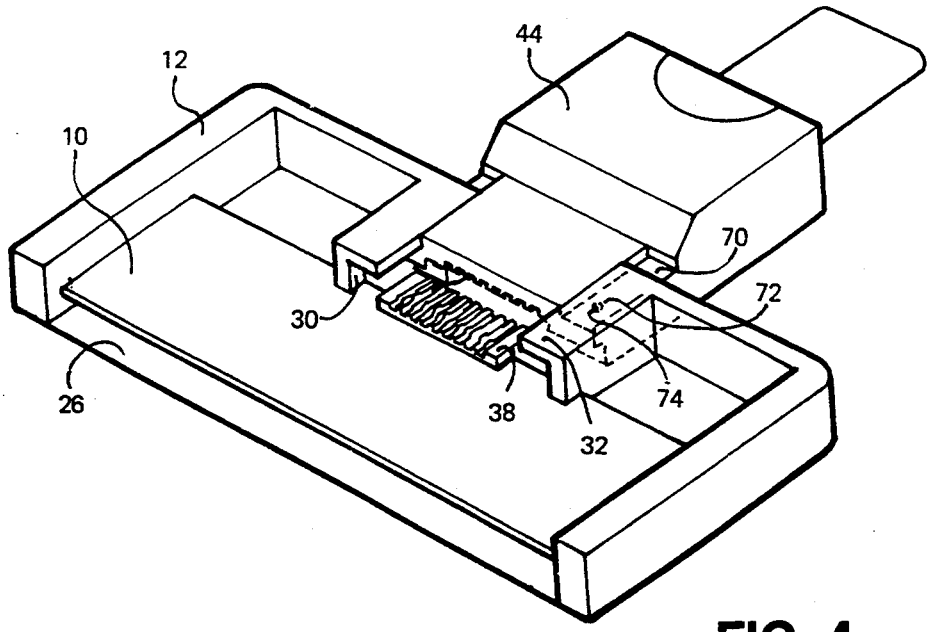
FIG. 4 is a perspective view of a further embodiment of connector assembly according to the present invention.

A further embodiment is shown in FIG. 4, in which the same parts are designated by the same reference numerals. The embodiment of FIG. 4 differs from that of FIGS. 1 to 3 in that it features an alternative arrangement of inter-engageable projections and recesses. In this embodiment, a shoulder 70 on each side of the plug element 44 is formed with a dimple 72 and the upper wall 32 of the opening 28 is formed with a corresponding rounded bump 74 on each side. The advantage of this embodiment is that, when the plug element 44 is locked in place within the opening 28, the rounded bumps 74 continually urge a front portion of the plug element body 48 downwardly to increase the pressure between the metal contacts 50 of the plug element 44 and the metal contacts 42 of the connector element 38.

Various modifications are possible within the scope of the invention. For example, the relative positions of the projections and recesses may be reversed.

The described connector assembly is of simple construction, can be made extremely compact, provides a reliable electrical connection, and is designed to withstand repeated connection and re-connection without undue wear to the printed circuit card 10, and the plug and connector elements 44 and 38.

The description above has been offered for illustrative purposes only, and it is not intended to limit the scope of the invention of this application which is defined in the following claims.

I claim:

1. An electronic card comprising:
a printed circuit board;
an electrical connector attached to an end of said printed circuit board having
a body having ribs separating first metal contacts, said first contacts wrap around said body and have a first end soldered to a respective conductive terminal on said printed circuit board and a second end spaced above said body and resiliently depressible toward said body; and
a plug element insertable within said electrical connector having
corresponding second contacts inter-engageable with said first contacts.

2. An electronic card assembly of claim 1 wherein:
said second contacts being metal strips extending from insulation of said plug.

3. An electronic card assembly of claim 1 wherein:
interconnection of said plug within said electrical connector brings said first contacts in wiping contact with said second contacts causing said first contacts to depress, forming a firm electrical connection.

4. An electronic card assembly of claim 1 wherein:
said electronic card assembly comprises
said electrical connector attached at one end of said printed circuit board for connection with external apparatus; and
a female connector attached at a second end of said printed circuit board for connection with internal apparatus.

5. An electronic card assembly of claim 1 wherein:
said electrical connector having slots around its periphery for frictionally engaging said printed circuit board upon sliding attachment thereto.

6. An electronic card assembly of claim 1 wherein:
said card assembly comprising
a housing having interior ridges for supporting a printed circuit board; and
an opening having side walls having projections for frictionally retaining said plug within said opening.

7. An electronic card assembly of claim 1 wherein:
said card assembly comprising a housing having interior ridges for supporting a printed circuit board; and
an opening having upper walls having a bump for frictionally engaging a corresponding dimple of a shoulder of said plug.

8. An electronic card assembly of claim 1 wherein:
said electrical connector having contact containing recesses which inter-engage with said corresponding second contacts of said plug.

9. An electronic card assembly comprising:
a printed circuit board;
an electrical connector attached to an end of said printed circuit board having
a body having
ribs separating first metal contacts and
slots around said body periphery for frictionally engaging a printed circuit board upon sliding attachment thereto;
said first contacts wrap around said body and each one having
a first end soldered to a respective I/O terminal of said printed circuit board and
a second end spaced above said body and resiliently depressible toward said body;
a plug element insertable within said electrical connector having
corresponding second contacts inter-engageable with said first contacts, said second contacts being metal strips extending from insulation of said plug wherein interconnection of said plug within said electrical connector brings said first contacts in wiping contact with said second contacts causing said first contacts to depress, forming a firm electrical connection; and
a housing having interior ridges for supporting a printed circuit board and
an opening having side walls having projections for frictionally retaining said plug within said opening.

10. An electronic card assembly comprising:

a printed circuit board;

an electrical connector attached to an end of said printed circuit board having a body having ribs separating first metal contact and slots around said body periphery for frictionally engaging a printed circuit board upon sliding attachment thereto;

said first contacts wrap around said body and each one having a first end soldered to a respective I/O terminal of said printed circuit board and a second end spaced above said body and resiliently depressible toward said body;

a plug element insertable within said electrical connector having corresponding second contacts inter-engageable with said first contacts, said second contacts being metal strips extending from insulation of said plug wherein interconnection of said plug within said electrical connector brings said first contacts in wiping contact with said second contacts causing said first contacts to depress, forming a firm electrical connection.

* * * * *